US011261766B1

(12) United States Patent
Dudar

(10) Patent No.: US 11,261,766 B1
(45) Date of Patent: Mar. 1, 2022

(54) OIL DILUTION DIAGNOSTIC TEST

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/106,696

(22) Filed: Nov. 30, 2020

(51) Int. Cl.

| | |
|---|---|
| ***F01M 11/10*** | (2006.01) |
| ***F02D 41/22*** | (2006.01) |
| ***G07C 5/08*** | (2006.01) |
| ***F01M 13/00*** | (2006.01) |
| ***F02M 35/10*** | (2006.01) |

(52) U.S. Cl.
CPC ..... *F01M 11/10* (2013.01); *F01M 13/0011* (2013.01); *F02D 41/22* (2013.01); *F02M 35/10222* (2013.01); *G07C 5/0808* (2013.01); *G07C 5/0816* (2013.01); *F01M 2011/142* (2013.01); *F01M 2011/1426* (2013.01); *F01M 2011/1446* (2013.01); *F01M 2011/1473* (2013.01); *F02D 2041/225* (2013.01); *F02D 2041/228* (2013.01)

(58) Field of Classification Search
CPC ..... F01M 11/10; F01M 13/0011; F01M 2011/142; F01M 2011/426; F01M 2011/1473; F01M 2011/1446; G07C 5/0816; G07C 5/0808; F02D 41/22; F02D 2041/228; F02D 2041/225; F02M 35/10222
See application file for complete search history.

(56) References Cited

U.S. PATENT DOCUMENTS

| | | | | |
|---|---|---|---|---|
| 5,708,202 | A | 1/1998 | Augustin et al. | |
| 5,720,253 | A * | 2/1998 | Matoba | F02F 3/26 123/298 |
| 7,392,792 | B2 | 7/2008 | Puckett | |
| 8,191,533 | B2 | 6/2012 | Ulrey et al. | |
| 9,403,427 | B2 | 8/2016 | Haladyna et al. | |
| 10,100,770 | B2 | 10/2018 | Dudar | |
| 10,767,590 | B1 * | 9/2020 | Jentz | G07C 5/0808 |
| 2017/0314432 | A1 * | 11/2017 | Dwivedi | F02M 25/06 |
| 2020/0400050 | A1 * | 12/2020 | Jentz | F01M 13/00 |

FOREIGN PATENT DOCUMENTS

JP 2007127076 A 5/2007

* cited by examiner

*Primary Examiner* — George C Jin
(74) *Attorney, Agent, or Firm* — Geoffrey Brumbaugh; McCoy Russell LLP

(57) ABSTRACT

Methods and systems are provided for diagnosis of oil dilution in an engine. In one example, a method may include sealing a crankcase and spinning an engine unfueled to heat and vaporize the oil in response to detection of rich engine operation. Pressure measurements at the sealed crankcase may be collected and compared to a baseline to diagnose a presence of fuel in the oil.

20 Claims, 6 Drawing Sheets

OIL DILUTION DIAGNOSTIC TEST

FIELD

The present description relates generally to methods and systems for diagnosing oil dilution by fuel in an engine.

BACKGROUND/SUMMARY

Oil may be used to reduce wear on engine components by reducing friction between moving components. However, leaks may occur which may lead to mixing of fuel with the oil, and cause engine oil dilution. This dilution results in the engine oil having a lower viscosity and higher volatility, degrading the lubricating capability of the oil. If left unaddressed, the engine components may experience increased wear and tear, leading to costly maintenance and repairs. In some examples, fuel may be mixed into the oil due to leaky fuel injectors. The leaky fuel injectors, in addition to diluting the oil, may also increase tailpipe emissions and leave deposits in the crankcase.

A presence of fuel in the oil may lead to a diagnostic trouble code (DTC) for rich engine operation to be set. However, various issues may cause rich combustion. For example, a degraded universal exhaust gas oxygen (UEGO) sensor, variability in combustion events, an incompatible fuel blend, etc., may activate the rich DTC in addition to oil dilution by fuel. While the vehicle onboard diagnostics (e.g., OBD-II) is able to detect rich engine operation, the OBD data does not provide information regarding the source of the rich DTC. In some examples, a fuel odor may be detectable in the engine oil, thereby alerting an operator to the presence of fuel in the oil, but may not be a reliable method of detection. Efforts to accurately determine the cause of the rich DTC may incur high costs in addition to repairs, thus a method for robustly identifying oil dilution is needed.

In order to address this issue, diagnostic tests may be implemented by a vehicle control system to alert the operator to oil dilution. In one example, as shown by Japanese Patent No. 2007127076, a method for indicating fuel-oil dilution is based on monitoring an AFR during different combustion states. Therein, the AFR during combustion at low engine temperature (e.g., high fuel pressure) is compared to the AFR during combustion at high engine temperature (e.g., low fuel pressure). Fluctuations in the AFR upon increased engine temperature may indicate formation of blow-by gases resulting from vaporization of fuel in the oil and degraded fuel injector operation is inferred.

However, the inventors herein have recognized issues with the diagnostic method described above. As an example, while variations in the AFR is indicative of an increase in off-stoichiometric fuel combustion due to an engine issue, the method does not isolate oil dilution as an exclusive source of a rich AFR. For example, combustion of an incompatible fuel blend may have a similar effect on the AFR. Thus, a method that monitors a different parameter other than the AFR may provide a more robust diagnosis.

In one example, oil dilution in an engine due to leaky fuel injectors may be diagnosed by, responsive to detection of rich engine operation, sealing a crankcase and spinning an engine unfueled to heat an engine lubricant and collecting pressure measurements at the crankcase and comparing the pressure measurements to a baseline to diagnose a presence of fuel in the engine lubricant. By monitoring the pressure at the sealed crankcase without concurrent engine operation, combustion effects may be precluded and leaky fuel injectors may be diagnosed via a reliable and low cost method.

For example, a positive crankcase ventilation (PCV) system of the engine may be leveraged to isolate the crankcase. The engine may be adapted with an additional valve arranged in a vent tube of the PCV system to enable sealing of the crankcase in conjunction with a PCV valve. Prior to running the diagnostic method after a drive cycle is complete, a baseline set of pressure measurements for the oil may be established and used to set a threshold pressure which may define a boundary between uncontaminated oil and diluted oil. When a rich DTC is triggered by the OBD-II, the pressure measurements collected at the crankcase may be compared to the threshold pressure. If oil dilution is verified, a new DTC indicating leaky fuel injectors may be set as well as an oil change alert.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
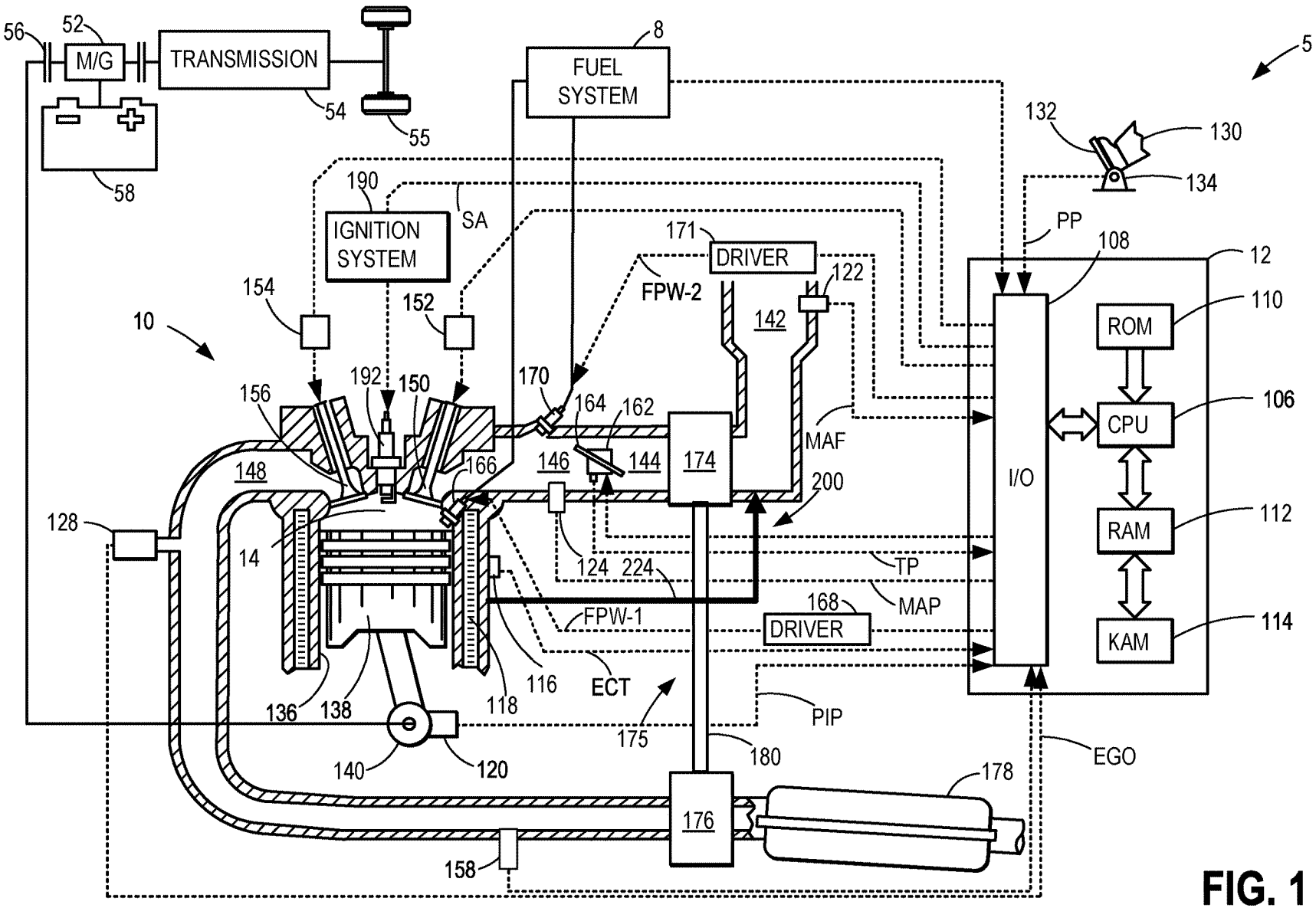
FIG. 1 shows an example engine configuration with an integrated positive crankcase ventilation (PCV) system.
Figure 2:
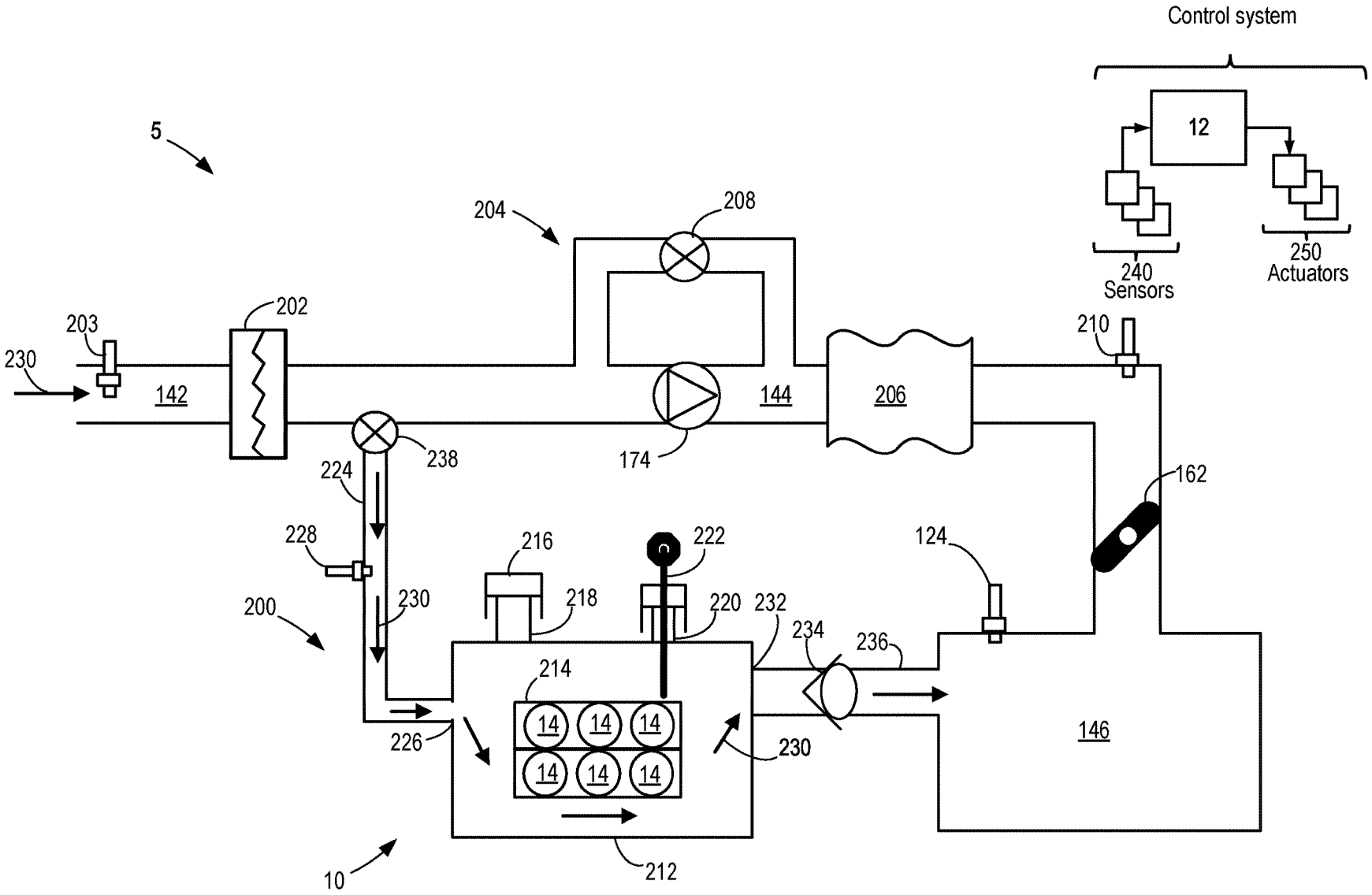
FIG. 2 shows a detailed schematic of the engine system and PCV system of FIG. 1.
Figure 5:
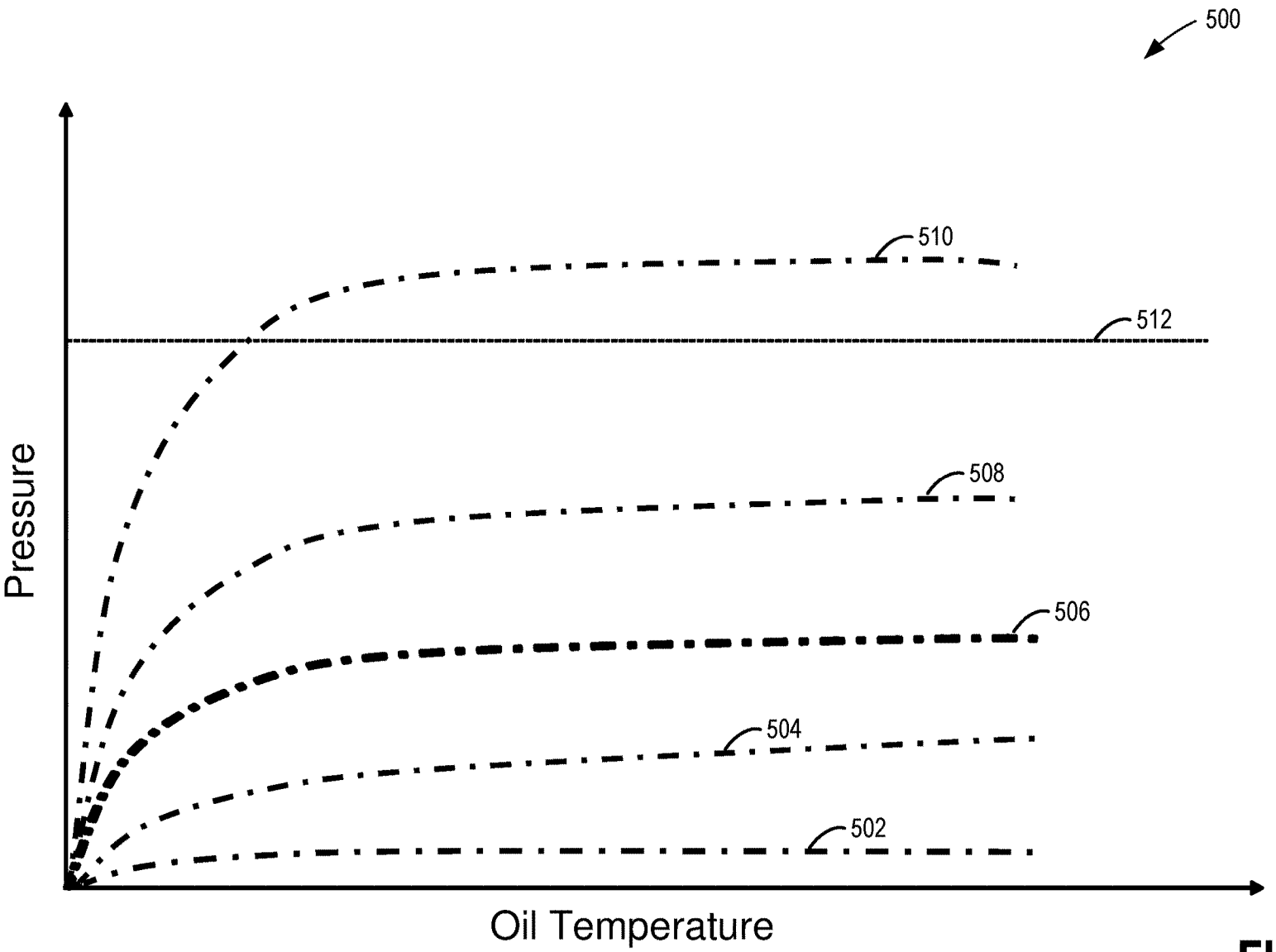
FIG. 5 shows an example of a diagnostic graph that may be used to diagnose an oil status in an engine.
Figure 6:
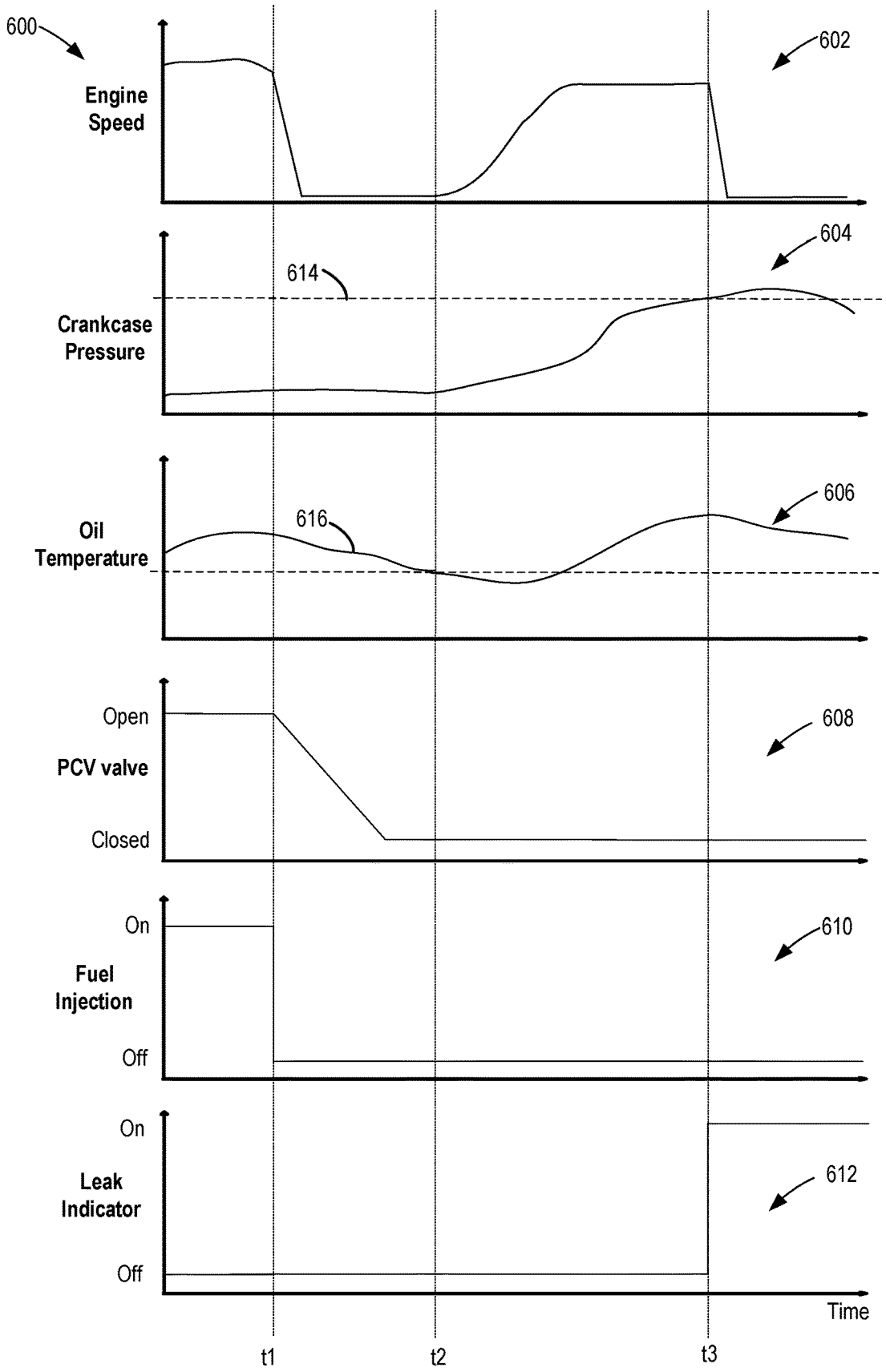
FIG. 6 shows a graph depicting example engine operations and conditions during diagnosis of oil dilution.

The following description relates to systems and methods for an oil dilution diagnostic test. An engine, as shown in FIG. 1, is injected with fuel to feed a combustion reaction that drives movement of pistons in the engine. Oil may be used as a lubricant within the crankcase to reduce friction between moving engine components. In some instances, the combustion reaction may lead to rich operation of the engine (e.g., combusting an excessively rich of stoichiometry mixture, which may be detected by exhaust air-fuel ratio sensors, for example), causing a DTC to be set. However, the DTC does not identify the source of off-stoichiometric combustion and therefore the oil dilution diagnostic test may be conducted to confirm if the DTC is caused by oil dilution as a result of leaking fuel injectors. In one example, a positive crankcase ventilation (PCV) system of the engine may be leveraged to seal a crankcase of the engine. An example of the PCV system is shown in FIG. 2. By sealing the crankcase, the pressure within the crankcase may be monitored while spinning the engine unfueled to diagnose a presence of fuel in the oil. Examples of methods for confirming oil dilution are shown in a high-level method in FIG. 3 and a method for conducting the oil dilution diagnostic test in FIG. 4. The pressure in the crankcase may be compared to a baseline and a threshold pressure, as shown in a diagnostic graph in FIG. 5. Examples of engine operations and conditions occurring during determination of oil dilution, as well as activation of a leak indicator, are shown in FIG. 6.

Turning now to FIG. 1, an example of a cylinder 14 of an internal combustion engine 10 is illustrated, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one drive wheel 55 of the passenger vehicle via a transmission 54, as described further below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a braking operation.

Cylinder 14 of engine 10 can receive intake air via an air induction system (AIS) including a series of intake passages 142, 144, and intake manifold 146. Intake manifold 146 can communicate with other cylinders of engine 10 in addition to cylinder 14, as shown in FIG. 2. In some examples, one or more of the intake passages may include a boosting device, such as a turbocharger or a supercharger. For example, FIG. 1 shows engine 10 configured with a turbocharger 175, including a compressor 174 arranged between intake passages 142 and 144 and an exhaust turbine 176 arranged along an exhaust passage 148. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

The AIS of vehicle 5 may also include a positive crankcase ventilation (PCV) system 200. Only a portion of the PCV system 200 is depicted in FIG. 1 for clarity and additional components of the PCV system 200 are shown in FIG. 2 and described further below. More specifically, a crankcase vent tube (CVT) is shown in FIG. 2, coupling intake passage 142 to a crankcase of engine 10. The CVT allows intake air to be drawn into the crankcase to purge the crankcase of blow-by gases when a PCV valve (as shown in FIG. 2) is open. In this way, degradation of crankcase components is circumvented which may otherwise occur due to prolonged exposure to the gases and accumulation of gas residues.

Exhaust passage 148 can receive exhaust gases from other cylinders of engine 10 in addition to cylinder 14. An exhaust gas sensor 128 is shown coupled to exhaust passage 148 upstream of an emission control device 178. Exhaust gas sensor 128 may be selected from among various suitable sensors for providing an indication of exhaust gas air/fuel ratio (AFR), such as a linear oxygen sensor or UEGO (universal or wide-range exhaust gas oxygen), a two-state oxygen sensor or EGO (as depicted), a HEGO (heated EGO), a NOx, a HC, or a CO sensor, for example. Emission control device 178 may be a three-way catalyst, a NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake poppet valve 150 may be controlled by controller 12 via an actuator 152. Similarly, exhaust poppet valve 156 may be controlled by controller 12 via an actuator 154. The positions of intake poppet valve 150 and exhaust poppet valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples the engine may ignite the charge by compression as in a diesel engine.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to the pulse width of a signal FPW-1 received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

Fuel injector 170 is shown arranged in intake manifold 146, rather than in cylinder 14, in a configuration that provides what is known as port fuel injection (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake poppet valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a pressure in the CVT (as shown in FIG. 2) measured by a crankcase pressure CKCP sensor (as shown in FIG. 2), a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 148; a profile ignition pickup signal (PIP) from a Hall effect sensor 120 (or other type) coupled to crankshaft 140; throttle position (TP) from a throttle position sensor; signal EGO from exhaust gas sensor 128, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold 146. Controller 12 may infer an engine temperature based on the engine coolant temperature and infer a temperature of catalyst 178 based on the signal received from temperature sensor 158. Additional sensors providing data to controller 12 are shown in FIG. 2 and described further below.

Controller 12 receives signals from the various sensors of FIGS. 1 and 2 and employs various actuators of FIGS. 1 and 2 to adjust engine operation based on the received signals and instructions stored on a memory of the controller. For example, upon receiving a signal from the MAP sensor 124, controller 12 may command opening of a positive crankcase ventilation (PCV) valve, as shown in FIG. 2 and described below, to vent the crankcase when the pressure in the intake manifold falls below a threshold value.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

An engine, e.g., engine 10 of FIGS. 1 and 2, may include a crankcase enclosing one or more cylinder bores as well as other engine components, such as crankshaft 140 of FIG. 1, an oil well (not shown) arranged below the crankshaft, etc. During a power stroke of the engine cylinders, a portion of the gases combusted within the cylinders may leak past a ring forming a seal around bases of the cylinder pistons in a process known as blow-by. The escaped blow-by gases may accumulate in the crankcase, resulting in a buildup of pressure which may degrade oil stored in the crankcase to lubricate piston movement. To preserve oil integrity and alleviate pressure in the crankcase, the engine may include a crank ventilation system, e.g., a PCV system, to vent gases out of the crankcase and into an intake manifold, e.g., intake manifold 146 of FIGS. 1 and 2.

FIG. 2 shows the PCV system 200 implemented in vehicle 5 in greater detail. In one example, the PCV system 200 may be coupled to the engine 10 of FIG. 1 and as such, common components are similarly numbered in FIG. 2 and will not be re-introduced. A barometric pressure (BP) sensor 203 may be positioned proximate to an inlet of intake passage 142 to measure ambient pressure. An air filter 202 may be arranged in a pathway of air flow into intake passage 142 to remove particulate matter from incoming fresh air. Intake passage 142 further includes a first end of a compressor bypass 204 upstream of compressor 174. A second end of the compressor bypass 204 may couple to intake passage 144, downstream of compressor 174 and upstream of a charge air cooler (CAC) 206.

Compressor bypass 204 may route air around compressor 174 when a compressor bypass valve (CBV) 208 is open. Alternatively, air may be boosted by compressor 174 when an opening of the CBV 208 is adjusted to be less open or closed to force at least a portion of incoming air through compressor 174. Air flowing into intake passage 144 may be cooled via CAC 206, increasing a power density of the air prior to combustion at the engine 10. Intake passage 144 includes a throttle inlet pressure (TIP) sensor 210 downstream of CAC 206 and upstream of throttle 162 to detect a pressure in intake passage 144 and flows air in intake manifold 146. Passages coupling intake manifold 146 to each cylinder 14 of engine 10 are omitted in FIG. 2 for brevity.

Engine 10 is depicted with a crankcase 212 enclosing cylinder banks 214 with cylinders 14. The cylinder banks 214 may be arranged, in one example, in a "V" configuration, e.g., V6. However, other engine configurations have been contemplated. The crankcase 212 includes an oil fill cap 216 sealing an oil fill port 218 which allows delivery of oil to an oil well. The crankcase 212 also has a dipstick port 220 supporting a dipstick 222 used to measure an oil level in the oil well. A plurality of other orifices may be disposed in the crankcase 212 for servicing components in the crankcase 212 and may be maintained closed during engine operation to allow the PCV system 200 to operate.

The PCV system 200 is coupled to the AIS and the crankcase 212 of vehicle 5 by a CVT 224. The CVT 224 extends between intake passage 142, at a point downstream of the air filter 202 and upstream of the compressor bypass 204 and may be attached to intake passage 142 by a first fitting, such as a quick-connect fitting. However, other couplings are possible. The CVT 224 may attach to the crankcase 212 at a second fitting, which may be a quick-connect fitting.

A crankcase pressure (CKCP) sensor 228 may be arranged in the CVT 224. The CKCP sensor 228 may be configured as an absolute pressure sensor or a gauge sensor, in some examples. In other examples, the sensor 228 may instead be a flow sensor or flow meter. While the CKCP sensor 228 is positioned in the CVT 224 in FIG. 2, the CKCP sensor 228 may be positioned at other locations within the PCV system 200 in other examples.

Intake air may flow, as indicated by arrows 230, from intake passage 142 into CVT 224, into the crankcase 212 at an outlet 226 of the CVT 224 and exit the crankcase 212 to flow through an inlet 232 of a PCV line 236 when a first, PCV valve 234 is open. The PCV valve 234, in one example, may be a one-way valve (e.g., a passive valve that seals when flow is in an opposite direction), that opens to provide forward flow when pressure in intake manifold 146 is low, e.g., under vacuum. The PCV valve 234 may vary its flow restriction in response to a pressure drop across the valve, as an example. Alternatively, in other examples, the PCV valve 234 may not be a one-way valve. For example, the PCV valve 234 may be an electronically controlled valve adjusted by controller 12. It will be appreciated that the PCV valve 234 may be configured as any of a variety of valve types without departing from the scope of the present disclosure.

When the pressure in intake manifold 146 is sufficiently low, e.g., below a threshold pressure such as atmospheric pressure, the PCV valve 234 may open to allow blow-by gases to flow to intake manifold 146 via the PCV line 236, which couples the crankcase 212 to intake manifold 146. Thus the crankcase 212 may be vented in a controlled manner.

An additional, second valve 238 may be located in the CVT 224, proximate to an intersection of the CVT 224 and intake passage 142. The second valve 238 may be, for example, an electrically, mechanically, pneumatically, or hydraulically controlled valve. During engine operation, the second valve 238 is maintained open, allowing intake air to flow unimpeded through the CVT 224 and into the PCV system 200. The second valve 238 may be adjusted closed to block intake air flow into the crankcase 212. By closing both the second valve 238 and the PCV valve 234, the crankcase 212 may be isolated from the AIS and intake manifold 146. In other words, the crankcase 212 may be sealed by the valves such that air and gases do not exchange between the crankcase 212 and components coupled to the crankcase via the PCV system 200.

Figure 4:
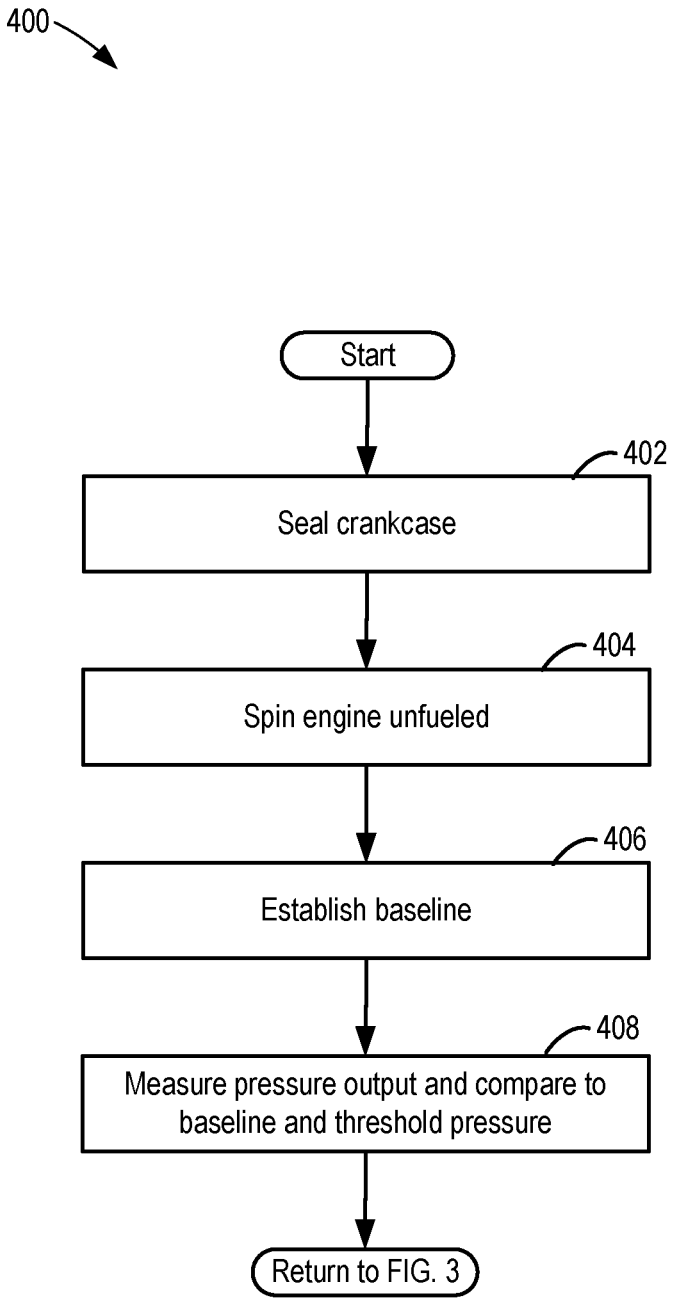
FIG. 4 shows an example of a method for conducting the oil dilution diagnostic test.

As described above for FIG. 1, the CKCP sensor 228 may be one of a number of sensors 240 arranged in the vehicle 5, sending signals to the controller 12. In response, the controller 12 may send commands to any of a variety of actuators 250 disposed in vehicle 5. As an example, pressure measurements provided by the CKCP sensor 228 may be leveraged to diagnose a presence of fuel in the oil when the PCV valve 234 and the second valve 238 are actuated to closed positions to seal the crankcase 212 while the engine 10 is spun unfueled, as described below and as shown in FIGS. 4 and 5.

Oil may become diluted by fuel when leakage occurs at one or more fuel injectors of an engine. The fuel mixes with the oil, reducing a viscosity of the oil which lowers a lubricating capacity of the oil. As a result, a longevity of engine components may be decreased, leading to increased maintenance and repairs. Furthermore, the dilution of oil by fuel may increase vehicle tailpipe emissions and also deposit fuel residue inside a crankcase of the engine.

A degraded fuel injector(s) may leak fuel into combustion chambers of the engine, causing rich operation of the engine.

The rich operation may be detected, triggering a DTC indicating the non-stoichiometric, rich combustion. However, current DTCs implemented in OBD-II systems provide notification of rich engine combustion but do not indicate a cause of the rich operation. Various sources may contribute to a setting of the rich DTC, including a degraded UEGO, a poor combustion event, an incompatible fuel, etc., in addition to fuel leakage at the fuel injector(s). This may lead to prolonged operation of the vehicle with the leaky fuel injector(s), thus exacerbating engine degradation. In addition, accurate diagnosis of the source of elevated fuel combustion may be time consuming and costly.

In order to efficiently identify the cause of the rich DTC, a vehicle control system may be configured to run an oil dilution diagnostic. The oil dilution diagnostic may leverage an ability to isolate the crankcase due to incorporation of a PCV system at the engine. The PCV system, including an additional valve upstream of the crankcase, e.g., the second valve 238 of FIG. 2, may be used to seal the crankcase while the engine is not operating. Spinning the engine unfueled with the crankcase sealed agitates the oil (and fuel mixed with the oil) and increases a temperature of the oil, leading to vaporization of the more volatile fuel. By comparing a set of pressure measurements in the crankcase to a baseline set of pressure measurements (e.g., pressure data collected when the rich DTC is triggered), the presence of fuel in the oil may be confirmed.

Upon verifying that the rich DTC is due to oil dilution, a new DTC may be set which indicates that the fuel injector(s) may be the source of rich combustion. Furthermore, an alert may be activated to notify an operator that an oil change is demanded. For example, an oil indicator light may be illuminated or a message may be displayed at a dashboard user interface of the vehicle. In this way, a combination of the rich DTC, the new DTC, and the oil change notification, where the oil change notification is displayed regardless of whether the vehicle is due for an oil change based on mileage/time since previous oil change, may provide sufficient information to guide examination of the fuel injector(s).

Figure 3:
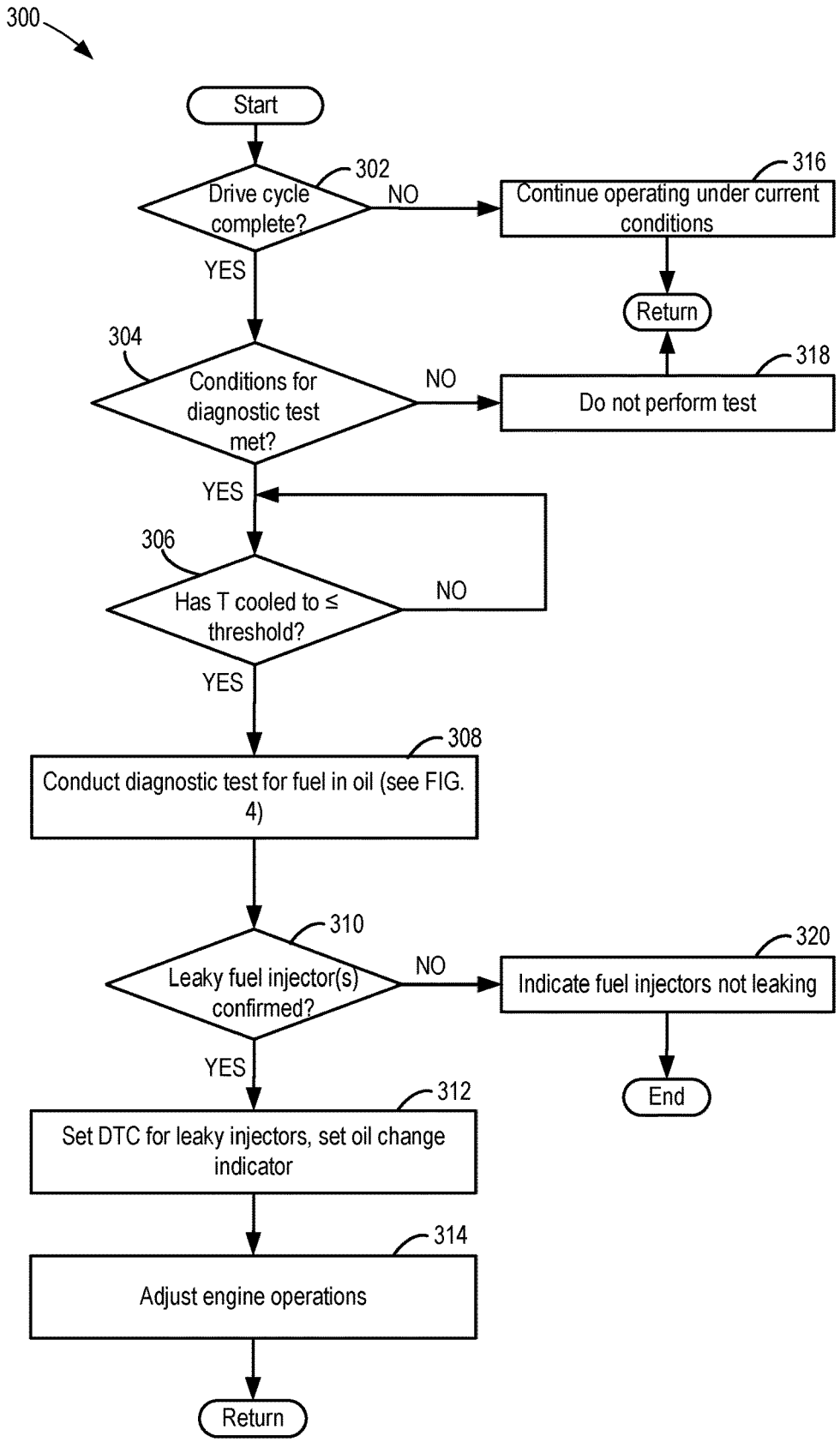
FIG. 3 shows an example of a high-level method for identifying a source of rich combustion in an engine using an oil dilution diagnostic test.

Methods for diagnosing oil dilution in an engine are shown in FIGS. 3 and 4. Method 300 of FIG. 3 is a high-level method for identifying conditions leading to implementation of method 400 of FIG. 4, which is an oil dilution diagnostic test. Methods 300 and 400 may be conducted in a vehicle configured with a PCV system, such as the PCV system 200 of FIG. 2. The PCV system includes a CKCP sensor arranged in a CVT of the system. In addition to a PCV valve controlling flow of blow-by gases from the engine crankcase to an intake manifold, a second valve may be arranged in the CVT, proximate to an intersection of the CVT with an AIS of the engine. Instructions for carrying out methods 300 and 400 may be executed by a controller, such as controller 12 of FIGS. 1 and 2, based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below.

Turning first to FIG. 3, at 302, the method 300 includes confirming if a drive cycle has been completed. The drive cycle may be deemed complete if the engine was operating previously and then shut down. As such, completion of the drive cycle may be verified by determining if an engine temperature, as measured by a temperature sensor such as the temperature sensor 116 of FIG. 1, is higher than ambient as an indication that the engine was operating, checking a status of a crankshaft as well as inferring engine speed from a Hall effect sensor, such as the Hall effect sensor 120 of FIG. 1. A PCM of the controller may be adjusted to a stand-by or "sleep" mode.

In examples where the vehicle is a hybrid electric vehicle, the drive cycle may be deemed complete when the vehicle is adjusted to operate via power supplied by a battery pack. The vehicle may therefore be in a stand-by mode with the engine turned off and cold but with vehicle operations enabled by the battery pack.

If the drive cycle is not complete, e.g., the engine is currently operating or the engine was not previously running, the method 300 continues to 316 to continue vehicle operations under current conditions. The method 300 returns to the start. If the drive cycle is confirmed to be complete, the method 300 proceeds to 304 to determine if conditions for performing the oil dilution diagnostic test are met.

These conditions may include but are not limited to a combustion status of the engine, engine oil temperature, etc. For example, the oil dilution diagnostic test may be performed only upon confirmation that a rich DTC is set, resulting from a lower-than-stoichiometric AFR detected by a UEGO, such as the exhaust gas sensor 128 of FIG. 1, detected during the driving cycle. The rich DTC may be stored in the controller's memory as a value in an OBD-II data set. Conducting the test may also be dependent upon the temperature of the oil having warmed to at least a first threshold temperature. The first threshold temperature may be an inferred oil temperature based on a measurement from a temperature sensor at the engine, such as the temperature sensor 116 of FIG. 1. When the oil temperature is at least the first threshold, the oil viscosity is lowered and the oil/fuel mixture (when the oil is diluted) may be readily vaporized when agitated. For example, the first threshold may be a temperature between 4-35 degrees C.

In some examples, determining if conditions for conducting the oil dilution diagnostic test are met may also include confirming an integrity of the PCV system. For example, the PCV system may be tested for a breach, such as a ruptured or disconnected CVT, during the previous drive cycle via a natural aspiration operation of the PCV system (e.g., a purge of the crankcase blow-by gases based on vacuum at the intake manifold). Various methods for testing an integrity of the PCV system are possible and are beyond the scope of the present disclosure.

If any of the conditions are not met, conducting of the diagnostic test is denied at 318 and the method returns to the start. In some examples, regardless of the other conditions, if the rich DTC is not set, the diagnostic test is not performed. If, however, the conditions are verified, the method continues to 306 to verify if the oil temperature, estimated based on the measured engine temperature, falls below a second threshold temperature. The second threshold temperature may be similar to or less than the first threshold temperature. In one example, the second threshold temperature may be a maximum temperature below which fuel is primarily in a liquid phase but high enough that the oil does not increase in viscosity. In order to evaluate leakage at a fuel injector(s) of the engine, the oil dilution diagnostic test may be dependent upon the oil/fuel mixture being entirely in the liquid phase prior to performing the test. Thus, if the oil temperature is above the second threshold temperature, the method continues checking the oil temperature until the engine cools down sufficiently. If the oil temperature is at or below the second threshold temperature, the method continues to 308 to conduct the oil dilution diagnostic test.

Conducting the test may include adjusting the PCM to a wake-up mode. Further details of the oil dilution diagnostic test are described further below with reference to method 400 of FIG. 5.

Upon completing the oil dilution diagnostic test, the method includes confirming if the fuel injector(s) is leaky at 310. If no leakage is detected, the method proceeds to 320 to provide confirmation that the oil is not diluted by fuel. As an example, an operator may be notified of a validated status of the oil by a message displayed at the dashboard user interface of the vehicle. In another example, if the vehicle dashboard does not include the user interface, no indication is provided and subsequent operation of the engine may proceed without any modifications or adjustments. In some examples, additional diagnostics may be activated to determine the source of the rich DTC. The method ends.

If the leaky fuel injector(s) is confirmed, the method continues to 312 to provide an indication to the operator that a problem is present in the engine, such as illuminating an oil change indicator and/or check engine light or displaying one or more alerts on the dashboard user interface. Furthermore, a new DTC specific to leakage at the fuel injector(s) may be set and added to the OBD-II data. For example, triggering of the DTC may cause an advisory message to be illuminated and/or flash to warn the operator that the oil is diluted. Thus the leaky fuel injector(s) may be identified as the cause of the rich DTC when the new DTC is set and the oil change indicator is activated. In particular, when the oil change indicator is activated before a routine oil change is anticipated, e.g., based on mileage or time since a previous oil change, a possible issue with an integrity of the oil is conveyed to the operator, increasing a likelihood that operator may bring the vehicle in for inspection or repairs where the new DTC may be identified.

At 314, the method includes adjusting engine operations to compensate for activation of the new DTC and the oil change indicator. For example, the engine may be operated in a reduced torque mode upon subsequent start-up to circumvent engine degradation and provide an additional alert to the operator. The method returns to the start. The method may be configured to be repeated based on a target increment of mileage. For example, the method may be repeated every 50 miles of vehicle navigation to evaluate whether the fuel in the oil increases. Detection of increasing oil dilution with engine operation may be further indicative of the leaky fuel injector(s).

Turning now to FIG. 4, it shows the method 400 for the oil dilution diagnostic test. At 402, the method includes isolating the crankcase by closing the PCV valve and the second valve. By closing the valves, the crankcase is sealed from the AIS and the intake manifold, e.g., exchange of gases between the crankcase and components coupled to the crankcase via the PCV system is blocked. Depending on a configuration of the PCV valve, a method for closing it may change. For example, the PCV valve, when configured as a passive valve, may be closed by opening an electronic throttle control (ETC) to remove vacuum in the intake manifold. Loss of vacuum at the intake manifold forces the PCV valve to close. Alternatively, if the PCV valve is electronically controlled, the valve may be commanded to close via a signal to an actuator of the PCV valve from the controller.

In addition, if the engine is equipped with variable camshaft timing, such as twin independent variable camshaft timing (Ti-VCT), for example, one or more intake valves at the engine cylinders may be opened early to release compression air to the intake manifold, thereby increasing intake manifold pressure (e.g., from vacuum) and forcing the passively configured PCV valve to close.

At 404, the method includes spinning the engine unfueled. In one example, this may be achieved by using a battery, such as the battery 58 of FIG. 1, to power an electric machine to rotate an engine crankshaft. As the engine is spun without injection of fuel, the oil (and fuel if present) is agitated which increases the temperature at the engine and causes the oil to vaporize. A pressure in the sealed crankcase may be measured by the CKCP sensor as the oil vaporizes.

The method includes establishing a baseline at 406. The baseline may be established by retrieving a first set of pressure measurements stored in the controller's memory. The first set of pressure measurements is obtained from the CKCP sensor and may be collected soon after an oil change, e.g., when the oil is clean and undiluted by fuel, the collection activated independent of methods 300 and 400. In other words, the baseline pressure measurements may be automatically collected after an oil change is performed. For example, pressure measurements may be collected immediately after an oil change is detected (and therefore the rich DTC is not set) and may be repeated several times within a threshold mileage of vehicle navigation subsequent to the oil change. The threshold mileage may be a distance travelled by the vehicle where the oil may still be relatively uncontaminated, such as within 50 miles of travel.

Alternatively, the repeated collection of the first set of pressure measurements may be conducted within a threshold period of time after the oil change, such as within one week. Each collection of the first set of pressure measurements includes sealing the crankcase and spinning the engine unfueled after a drive cycle is completed, as described above. The collected data may then be averaged to establish a pressure profile to be used for the baseline which may be stored in the controller's memory and retrieved when the oil dilution diagnostic test is conducted.

At 408, the method includes collecting the pressure measurements (initiated based on the setting of the rich DTC, as described at method 300), in the sealed crankcase to obtain a second set of pressure measurements. The second set of pressure measurements is compared to the baseline. An example of a comparison of pressure measurements at the sealed crankcase under different oil statuses is illustrated in FIG. 5.

FIG. 5 shows a graph 500 depicting pressure measurements for different oil conditions in the sealed crankcase as determined by the oil dilution diagnostic test. Pressure, as measured by a CKCP sensor, such as the CKCP sensor 228 of FIG. 2 is plotted along the y-axis and temperature is plotted along the x-axis. By plotting the pressure measurements relative to oil temperature (inferred based on engine temperature) the measurements may be normalized to temperature. The graph 500 includes a first plot 502, showing pressure measurements of oil that is at an end of its useful life, a second plot 504 showing pressure measurements of oil at a mid-point of its useful life, a third plot 506 showing pressure measurements for relatively fresh oil (e.g., within a threshold period of time/mileage after an oil change), a fourth plot 508 showing an amount of oil dilution (e.g., by fuel) that triggers a rich DTC, and a fifth plot 510 showing an increased amount of oil dilution, as determined by the oil dilution diagnostic. The first, second, and third plot 502, 504, and 506 show data for intact fuel injectors, where no fuel leakage into the oil occurs. The third plot 506 is the baseline which may be obtained as described above.

Graph 500 also includes a threshold 512, which is a threshold pressure representing an increase in pressure by a preset amount above a plateau region of the established baseline. In one example, the threshold 512 may be determined by performing a fault injection test where a leaky injector is implemented in the engine and the oil dilution diagnostic test is conducted to obtained a corresponding set of pressure measurements recorded by the CKCP sensor. The test results may be compared to the baseline to generate the threshold 512.

When the pressure in the crankcase rises above the threshold 512, one or more leaky fuel injectors are verified be the source of oil dilution. Thus, pressure measurements obtained via the oil dilution diagnostic test may be compared to the threshold pressure, which is established based on the baseline, to evaluate an integrity of the fuel injectors. The oil dilution diagnostic test may be concluded when the crankcase pressure reaches the threshold 512 within a pre-set duration of time, such as 60 seconds, or when the pre-set duration of time elapses.

Returning to FIG. 4, upon obtaining the second set of pressure measurements and comparing the measurements to the threshold pressure, the method returns to FIG. 3 to confirm whether the fuel injector(s) is leaky at 310.

FIG. 6 shows a graph 600 depicting engine operations and conditions during an oil dilution diagnostic test performed in a vehicle using methods described above. The vehicle is configured with a PCV system, including a CKCP sensor, a PCV valve and an additional valve in a CVT of the PCV system, where the valves may be used to seal a crankcase of the engine. Graph 600 includes a plot 602 illustrating engine speed, a plot 604 showing crankcase pressure, a plot 606 showing oil temperature, a plot 608 showing a position of the PCV valve, a plot 610 showing fuel injection and a plot 612 depicting a status of a leak indicator. The leak indicator may include at least one of a malfunction indicator light (MIL), a DTC indicative of oil dilution/leaking fuel injectors, and an oil change alert. Plot 604 also includes a first threshold 614, which is a threshold pressure crankcase pressure above which oil dilution is indicated. Plot 606 includes a second threshold 616, which is a threshold oil temperature. The oil dilution diagnostic test may be conducted when the oil temperature is initially at or below the second threshold 616. Engine speed (plot 602), crankcase pressure (plot 604) and oil temperature (plot 606) increase along the y-axis, an open/closed position of the PCV valve is shown along the y-axis of plot 608, and fuel injection (plot 610) and the leak indicator (plot 612) are depicted with respect to an on/off status along the y-axis. The plots are illustrated relative to time along the x-axis.

Prior to time t1, the vehicle is being driven and the engine is operating, as indicated by the engine speed, and oil temperature is warm. Fuel is injected and crankcase pressure is low due to vacuum generation at an intake manifold during fuel combustion. The vacuum at the intake manifold forces the PCV valve to open when the PCV valve is a passive valve, thus communicating the low pressure at the intake manifold to the crankcase. The leak indicator is off. However, rich combustion is detected at the engine, triggering a rich DTC.

At t1, the drive cycle concludes, e.g., the engine is turned off and the engine speed decreases until the engine is stationary. The fuel injection stops. The engine cools, causing the oil temperature to decrease. The intake manifold may remain under vacuum at engine shutdown, thus adjustments, as described above, may be made to alleviate the vacuum to allow the PCV valve to close. As the PCV valve closes, the additional valve in the CVT of the PCV system is also closed, thereby sealing the crankcase.

The PCV valve may fully close between t1 and t2 but initiation of the oil dilution diagnostic test may be delayed until the oil temperature cools to the second threshold 616. At t2, the oil temperature falls to the second threshold 616 and the diagnostic test is run. The engine is spun without fuel injection which increases the oil temperature by agitating the oil and causing the oil to vaporize. As the oil warms and vaporizes, the crankcase pressure rises. At t3, the crankcase pressure exceeds the first threshold 614, indicating that fuel is present in the oil. The leak indicator is activated and the engine is stopped as the oil dilution diagnostic test ends. The crankcase pressure gradually decreases as the oil cools.

In this way, leakage at one or more fuel injectors resulting in oil dilution may be determined by a diagnostic method utilizing a PCV system of an engine. By sealing a crankcase of the engine via the PCV system and spinning the engine unfueled, pressure within the crankcase may be monitored and compared to a threshold pressure to detect a presence of fuel in the engine oil via an oil dilution diagnostic test. The sealing of the crankcase allows the fuel injectors to be verified as the source of fuel in the oil, thereby providing an onboard, accurate diagnosis of degraded fuel injectors without incurring additional costs. Upon confirming that the fuel injectors are leaking, an operator may be informed of a status of the oil and the fuel injectors by activation of a DTC specific to leaky fuel injectors as well as an oil change alert.

The technical effect of implementing the oil dilution diagnostic test, as described above, to address a DTC for rich engine combustion, is that degradation of fuel injectors is detected based on an increase in vapor pressure above a threshold pressure in the sealed crankcase.

The disclosure also provides support for a method for an engine, comprising: responsive to detection of rich engine operation, sealing a crankcase and spinning an engine unfueled to heat an engine lubricant, and collecting pressure measurements at the crankcase and comparing the pressure measurements to a baseline to diagnose a presence of fuel in the engine lubricant. In a first example of the method, the method further comprises: indicating a fuel leakage at one or more fuel injectors of the engine upon confirming the presence of the fuel in the engine lubricant and wherein indicating the fuel leakage includes setting a diagnostic trouble code (DTC) for the fuel leakage. In a second example of the method, optionally including the first example, indicating the fuel leakage further includes activating an alert for an oil change. In a third example of the method, optionally including the first and second examples, spinning the engine unfueled includes spinning the engine after the engine cools to at least a threshold temperature and wherein the threshold temperature is a temperature at which the engine lubricant is not vaporized. In a fourth example of the method, optionally including the first through third examples, sealing the crankcase includes closing valves of a positive crankcase ventilation (PCV) system, the valves including a first valve arranged upstream of the crankcase, at an intersection of an air induction system (AIS) of the engine and a PCV vent tube, and a second valve arranged downstream of the crankcase between the crankcase and an intake manifold. In a fifth example of the method, optionally including the first through fourth examples, spinning the engine unfueled includes commanding the first valve to close and forcing the second valve to close by venting vacuum at the intake manifold. In a sixth example of the method, optionally including the first through fifth examples, collecting the pressure measurements at the crankcase includes measuring a pressure detected by a crankcase pressure (CKCP) sensor positioned in the PCV vent tube, downstream of the first valve. In a seventh example of the method, optionally including the first through sixth examples, comparing the pressure measurements to the baseline includes retrieving a baseline set of pressure measurements stored in a memory of a controller and wherein the baseline set of pressure measurements are obtained within a threshold mileage and/or period of time after an oil change. In an eighth example of the method, optionally including the first through seventh examples, obtaining the baseline set of pressure measurements includes collecting pressure data while spinning the engine unfueled with the crankcase sealed. In a ninth example of the method, optionally including the first through eighth examples, diagnosing the presence of the fuel in the engine lubricant includes determining if a pressure in the crankcase rises a threshold amount above the baseline set of pressure measurements.

The disclosure also provides support for a method for diagnosing oil dilution in a vehicle, comprising: during a first condition, including the vehicle being in an engine-off mode and operating within a threshold mileage or duration of time subsequent to an oil change, spinning an engine unfueled and collecting a first set of pressure measurements at a sealed crankcase, and during a second condition, including detection of rich engine operation and the vehicle being in the engine-off mode, spinning the engine unfueled and collecting a second set of pressure measurements at the sealed crankcase, comparing the second set of pressure measurements to the first set of pressure measurements to identify an oil dilution by fuel in the engine, and indicating the oil dilution by setting a diagnostic trouble code (DTC) and activating an oil change alert. In a first example of the method, collecting the first set of pressure measurements at the sealed crankcase includes sealing the crankcase via a positive crankcase ventilation (PCV) system and wherein the PCV system includes a PCV vent tube extending between an air induction system (AIS) and an inlet of the crankcase and a first, PCV valve positioned between the crankcase and an intake manifold of the engine. In a second example of the method, optionally including the first example, sealing the crankcase includes closing the PCV valve and closing a second valve positioned upstream of the crankcase at an intersection of the AIS and the PCV vent tube. In a third example of the method, optionally including the first and second examples, closing the PCV valve includes at least one of opening an electronic throttle to remove vacuum from the intake manifold and opening an intake valve to add compression air to the intake manifold when the PCV valve is passive. In a fourth example of the method, optionally including the first through third examples, closing PCV valve includes commanding the PCV valve to close when the PCV valve is electronic. In a fifth example of the method, optionally including the first through fourth examples, the method further comprises: stopping the collection of the second set of pressure measurements when a pressure in the crankcase passes a threshold pressure within a pre-set duration of time or when the pre-set duration of time elapses. In a sixth example of the method, optionally including the first through fifth examples, collecting the first set of pressure measurements and collecting the second set of pressure measurements includes measuring a pressure in the crankcase by a crankcase pressure (CKCP) sensor.

The disclosure also provides support for an engine system for a vehicle, comprising: an engine lubricated by oil and configured with a positive crankcase ventilation (PCV) system, and a controller configured with executable instructions stored in non-transitory memory to conduct an oil dilution diagnostic test that, when executed, causes the controller to: upon detection of rich engine operation and confirmation of an engine-off mode of the vehicle, seal a crankcase of the engine, spin the engine unfueled, collect pressure measurements at the crankcase, compare the pressure measurements to a baseline to determine a presence of fuel in the oil, and indicate the presence of fuel in the oil by setting a diagnostic trouble code (DTC) and activating an oil change alert. In a first example of the system, the system further comprises: executable instructions to repeat the oil dilution diagnostic test based on an increment of vehicle mileage to confirm an increase in an amount of oil dilution. In a second example of the system, optionally including the first example, comparison of the pressure measurements to the baseline includes normalization of the pressure measurements to an oil temperature.

In another representation, a method includes, responsive to detection of rich combustion at an engine, determining a leakage at fuel injectors of the engine based on a pressure in a sealed crankcase of the engine while spinning the engine unfueled and indicating the leakage at the fuel injectors by activating a DTC and an oil change alert. In a first example of the method, determining the leakage the fuel injectors includes confirming a presence of fuel in oil lubricating the engine. A second example of the method optionally includes the first example, and further includes, wherein activating the DTC includes illuminating a malfunction indicator lamp. A third example of the method optionally includes one or more of the first and second examples, and further includes, wherein determining the leakage at the fuel injectors based on the pressure in the sealed crankcase includes one or more of opening an electronic throttle control and opening an intake valve of a twin inlet variable camshaft timing mechanism early to force a passive PCV valve to close. A fourth example of the method optionally includes one or more of the first through third examples, and further includes wherein determining the leakage at the fuel injectors based on the pressure in the sealed crankcase includes commanding an electronic PCV valve to close.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

responsive to detection of rich engine operation;

sealing a crankcase and spinning an engine unfueled to heat an engine lubricant; and collecting pressure measurements at the crankcase and comparing the pressure measurements to a baseline to diagnose a presence of fuel in the engine lubricant.

2. The method of claim 1, further comprising indicating a fuel leakage at one or more fuel injectors of the engine upon confirming the presence of the fuel in the engine lubricant and wherein indicating the fuel leakage includes setting a diagnostic trouble code (DTC) for the fuel leakage.

3. The method of claim 2, wherein indicating the fuel leakage further includes activating an alert for an oil change.

4. The method of claim 1, wherein spinning the engine unfueled includes spinning the engine after the engine cools to at least a threshold temperature and wherein the threshold temperature is a temperature at which the engine lubricant is not vaporized.

5. The method of claim 1, wherein sealing the crankcase includes closing valves of a positive crankcase ventilation (PCV) system, the valves including a first valve arranged upstream of the crankcase, at an intersection of an air induction system (AIS) of the engine and a PCV vent tube, and a second valve arranged downstream of the crankcase between the crankcase and an intake manifold.

6. The method of claim 5, wherein spinning the engine unfueled includes commanding the first valve to close and forcing the second valve to close by venting vacuum at the intake manifold.

7. The method of claim 5, wherein collecting the pressure measurements at the crankcase includes measuring a pressure detected by a crankcase pressure (CKCP) sensor positioned in the PCV vent tube, downstream of the first valve.

8. The method of claim 1, wherein comparing the pressure measurements to the baseline includes retrieving a baseline set of pressure measurements stored in a memory of a controller and wherein the baseline set of pressure measurements are obtained within a threshold mileage and/or period of time after an oil change.

9. The method of claim 8, wherein obtaining the baseline set of pressure measurements includes collecting pressure data while spinning the engine unfueled with the crankcase sealed.

10. The method of claim 8, wherein diagnosing the presence of the fuel in the engine lubricant includes determining if a pressure in the crankcase rises a threshold amount above the baseline set of pressure measurements.

11. A method for diagnosing oil dilution in a vehicle, comprising:

during a first condition, including the vehicle being in an engine-off mode and operating within a threshold mileage or duration of time subsequent to an oil change;

spinning an engine unfueled and collecting a first set of pressure measurements at a sealed crankcase; and during a second condition, including detection of rich engine operation and the vehicle being in the engine-off mode;

spinning the engine unfueled and collecting a second set of pressure measurements at the sealed crankcase;

comparing the second set of pressure measurements to the first set of pressure measurements to identify an oil dilution by fuel in the engine; and indicating the oil dilution by setting a diagnostic trouble code (DTC) and activating an oil change alert.

12. The method of claim 11, wherein collecting the first set of pressure measurements at the sealed crankcase includes sealing the crankcase via a positive crankcase ventilation (PCV) system and wherein the PCV system includes a PCV vent tube extending between an air induction system (AIS) and an inlet of the crankcase and a first, PCV valve positioned between the crankcase and an intake manifold of the engine.

13. The method of claim 12, wherein sealing the crankcase includes closing the PCV valve and closing a second valve positioned upstream of the crankcase at an intersection of the AIS and the PCV vent tube.

14. The method of claim 13, wherein closing the PCV valve includes at least one of opening an electronic throttle to remove vacuum from the intake manifold and opening an intake valve to add compression air to the intake manifold when the PCV valve is passive.

15. The method of claim 13, wherein closing PCV valve includes commanding the PCV valve to close when the PCV valve is electronic.

16. The method of claim 11, further comprising stopping the collecting of the second set of pressure measurements when a pressure in the crankcase passes a threshold pressure within a pre-set duration of time or when the pre-set duration of time elapses.

17. The method of claim 11, wherein collecting the first set of pressure measurements and collecting the second set of pressure measurements includes measuring a pressure in the crankcase by a crankcase pressure (CKCP) sensor.

18. An engine system for a vehicle, comprising:

an engine lubricated by oil and configured with a positive crankcase ventilation (PCV) system; and a controller configured with executable instructions stored in non-transitory memory to conduct an oil dilution diagnostic test that, when executed, causes the controller to:

upon detection of rich engine operation and confirmation of an engine-off mode of the vehicle, seal a crankcase of the engine;

spin the engine unfueled;

collect pressure measurements at the crankcase;

compare the pressure measurements to a baseline to determine a presence of fuel in the oil; and indicate the presence of fuel in the oil by setting a diagnostic trouble code (DTC) and activating an oil change alert.

19. The engine system of claim 18, further comprising executable instructions to repeat the oil dilution diagnostic test based on an increment of vehicle mileage to confirm an increase in an amount of oil dilution.

20. The engine system of claim 18, wherein comparison of the pressure measurements to the baseline includes normalization of the pressure measurements to an oil temperature.

* * * * *